US009228748B2

(12) United States Patent
Nelson et al.

(10) Patent No.: US 9,228,748 B2
(45) Date of Patent: Jan. 5, 2016

(54) FRAME STRUCTURE FOR AN APPLIANCE

(71) Applicant: General Electric Company, Schenectady, NY (US)

(72) Inventors: Nathan Ernell Nelson, Louisville, KY (US); William Byron Wiggins, Marietta, GA (US)

(73) Assignee: General Electric Company, Schenectady, NY (US)

( * ) Notice: Subject to any disclaimer, the term of this patent is extended or adjusted under 35 U.S.C. 154(b) by 260 days.

(21) Appl. No.: 13/951,981

(22) Filed: Jul. 26, 2013

(65) Prior Publication Data

US 2015/0027429 A1 Jan. 29, 2015

(51) Int. Cl.
*F24C 15/08* (2006.01)
*F24C 15/02* (2006.01)

(52) U.S. Cl.
CPC ..... *F24C 15/023* (2013.01)

(58) Field of Classification Search
CPC ..... F24C 15/00
USPC ..... 126/19 R, 194, 273 R
See application file for complete search history.

(56) References Cited

U.S. PATENT DOCUMENTS

| | | | | |
|---|---|---|---|---|
| 2,335,279 | A * | 11/1943 | Hobson | 126/39 B |
| 7,708,008 | B2 * | 5/2010 | Elkasevic et al. | 126/198 |
| 2007/0262590 | A1 * | 11/2007 | Courter et al. | 292/201 |
| 2008/0184985 | A1 * | 8/2008 | Hasslberger et al. | 126/21 R |

FOREIGN PATENT DOCUMENTS

| | | |
|---|---|---|
| GB | 236969 | 7/1925 |
| GB | 2100978 | 1/1983 |
| WO | WO 2010034833 | 4/2010 |

* cited by examiner

*Primary Examiner* — Avinash Savani
(74) *Attorney, Agent, or Firm* — Dority & Manning, P.A.

(57) ABSTRACT

A frame structure for an appliance, such as an oven appliance, is provided. The frame structure includes a pair of vertical rails and a pair of lateral rails. A pair of hinges is mounted to the vertical rails, and a door is mounted to the vertical rails with the pair of hinges. A control panel is also mounted to the pair of vertical rails.

16 Claims, 6 Drawing Sheets

FRAME STRUCTURE FOR AN APPLIANCE

FIELD OF THE INVENTION

The present subject matter relates generally to appliances, such as oven appliances, and frame structures for the same.

BACKGROUND OF THE INVENTION

Certain appliances include various components that are visible to appliance users. As an example, oven appliances generally include a door and a control panel that are mounted to an oven body. The door and the control panel can be positioned at an outer surface of the body such that the door and control panel are visible to a user of the oven appliance.

A position of the door and the control panel relative to each other can be important to the aesthetic appearance of the oven appliance. In certain oven appliances, the control panel is mounted to the body above the door such that the control panel and the door define a gap therebetween. A size of the gap can be important to the oven appliance's appearance. For example, a non-uniform gap that varies from one side of the oven appliance to the other can have a negative effect on the oven appliance's cosmetic appearance and on a consumer's impression of the oven appliance. However, controlling the gap's size can be difficult during assembly and manufacture of the oven appliance. In particular, keeping the size of the gap uniform can be difficult.

Accordingly, an appliance with features for assisting with mounting appliance components onto the appliance would be useful. In particular, an appliance with features for assisting with mounting appliance components onto the appliance such that a gap between the components is substantially uniform would be useful.

BRIEF DESCRIPTION OF THE INVENTION

The present subject matter provides a frame structure for an appliance, such as an oven appliance. The frame structure includes a pair of vertical rails and a pair of lateral rails. A pair of hinges is mounted to the vertical rails, and a door is mounted to the vertical rails with the pair of hinges. A control panel is mounted to the pair of vertical rails. Additional aspects and advantages of the invention will be set forth in part in the following description, or may be apparent from the description, or may be learned through practice of the invention.

In a first exemplary embodiment, an oven appliance is provided. The oven appliance defines a vertical direction and a lateral direction. The oven appliance includes an oven body having a frame structure positioned at a front portion of the body. The frame structure includes a pair of vertical rails and a pair of lateral rails. The lateral rails are spaced apart from each other along the vertical direction. The lateral rails extend between the vertical rails along the lateral direction such that the lateral rails couple the vertical rails to each other. The oven appliance also includes a door and a pair of hinges. Each hinge of the pair of hinges is mounted to a respective one of the vertical rails. The door is rotatably mounted to the pair of vertical rails with the pair of hinges. A control panel is also mounted to the pair of vertical rails.

In a second exemplary embodiment, a frame structure for an appliance is provided. The frame structure defines a vertical direction and a lateral direction. The frame structure includes a first vertical rail and a second vertical rail spaced apart from the first vertical rail along the lateral direction. A top rail extends between the first and second vertical rails along the lateral direction. A bottom rail extends between the first and second vertical rails along the lateral direction. The bottom rail is positioned below the top rail along the vertical direction. The frame structure also includes a door and a pair of hinges. Each hinge of the pair of hinges is mounted to a respective one of the first and second vertical rails. The door is rotatably mounted to first and second vertical rails with the pair of hinges. A control panel is also mounted to the first and second vertical rails.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
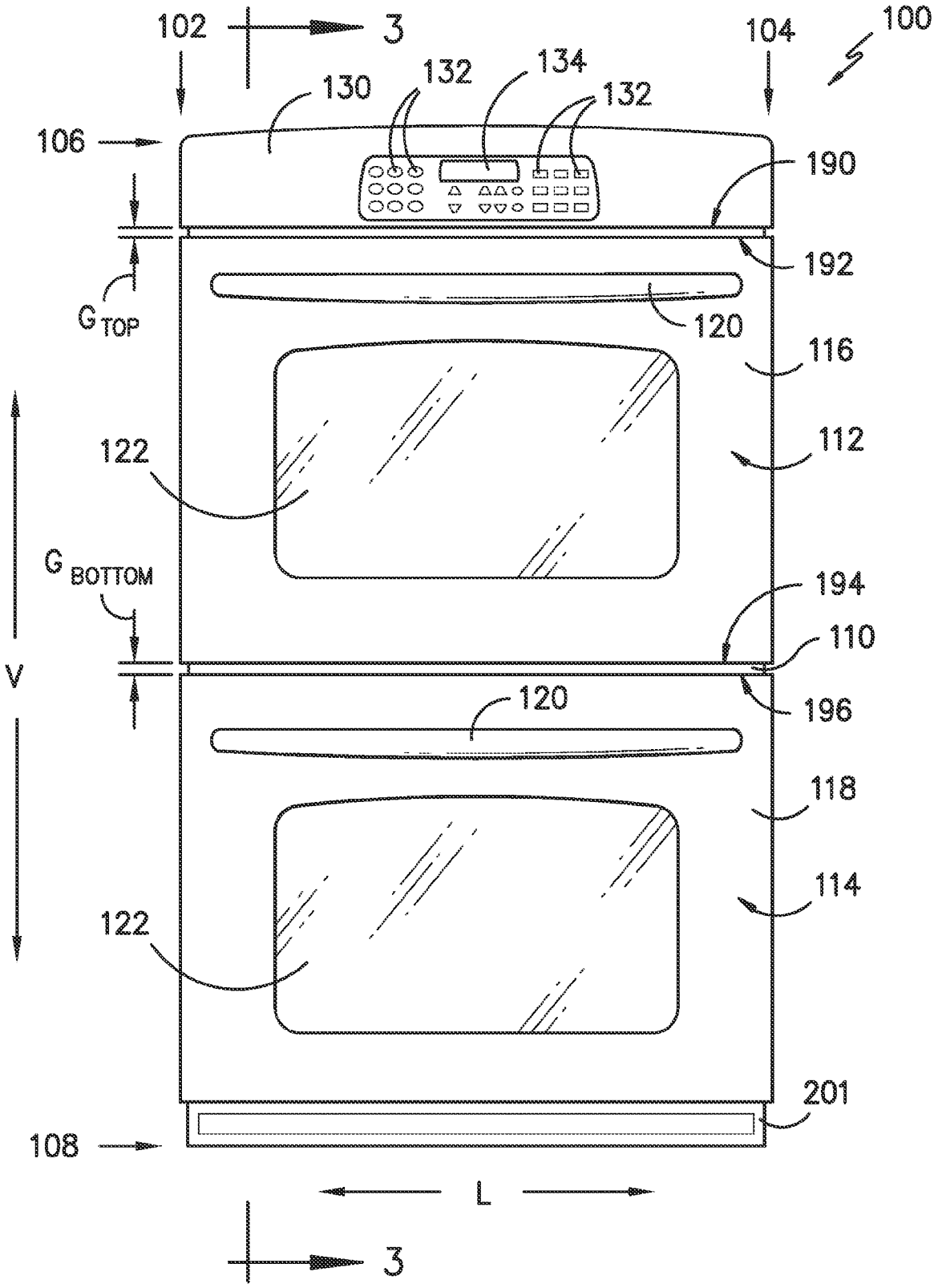
FIG. 1 provides a front, elevation view of an oven appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 3:
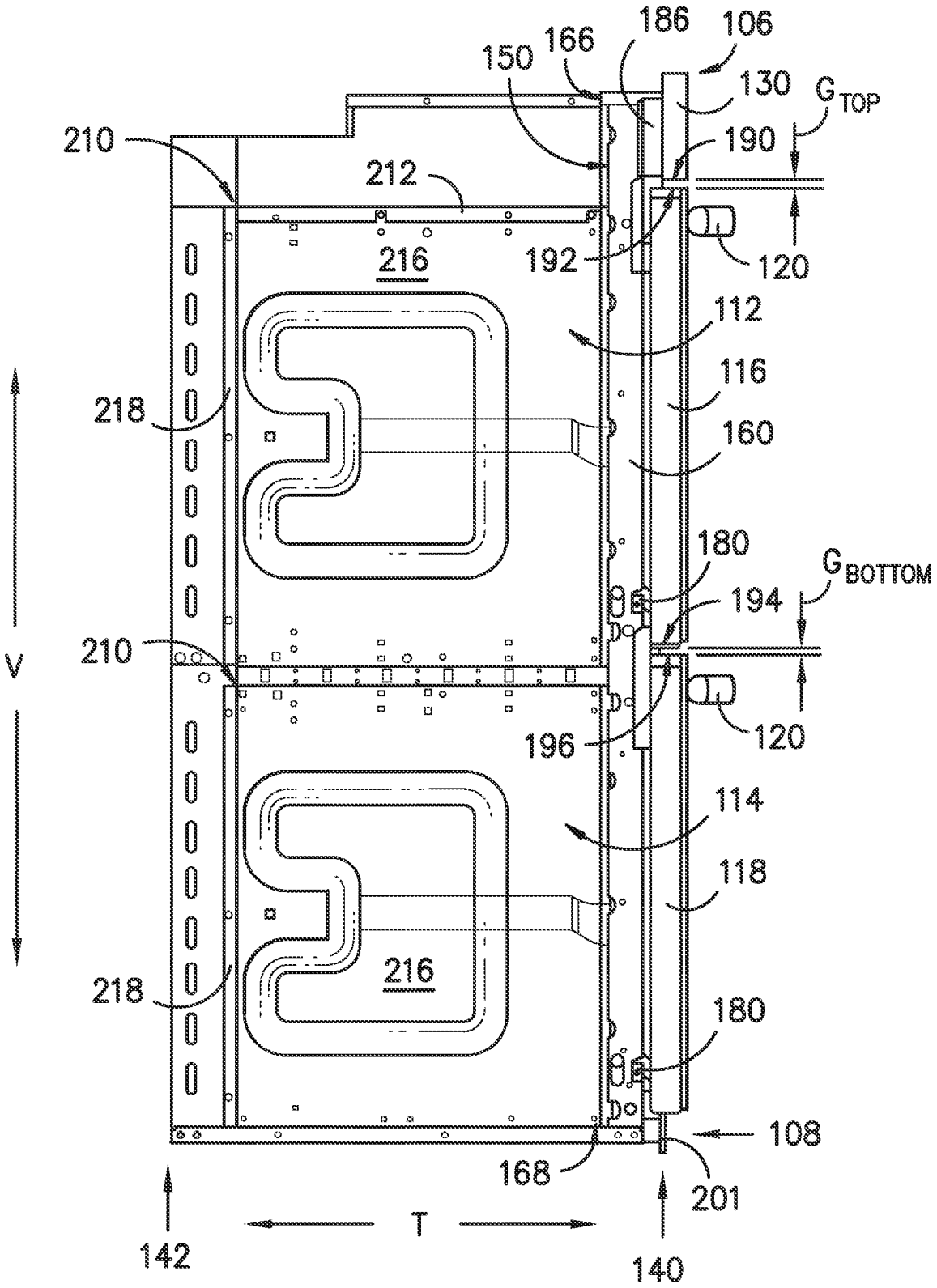
FIG. 3 provides a side, section view of the exemplary oven appliance of FIG. 1 taken along the 3-3 line of FIG. 1.

FIG. 1 provides a front, elevation view of an oven appliance 100 according to an exemplary embodiment of the present subject matter. Oven appliance 100 defines a vertical direction V, a lateral direction L and a transverse direction T (FIG. 3). The vertical direction V, lateral direction L and transverse direction T are mutually perpendicular and form an orthogonal direction system. Oven appliance 100 includes an insulated oven body 110 that extends between a first side portion 102 and a second side portion 104, e.g., along a lateral direction L. Body 110 also extends between a top portion 106 and a bottom portion 108, e.g., along the vertical direction V.

Body 110 defines an upper cooking chamber 112 and a lower cooking chamber 114. Upper cooking chamber 112 is positioned at or adjacent top portion 106 of body 110. Lower cooking chamber 114 is positioned at or adjacent bottom portion 108 of body 110. Oven appliance 100 is generally referred to as a double wall oven appliance. As will be understood by those skilled in the art, oven appliance 100 is provided by way of example only, and the present subject matter may be used in any suitable oven appliance, e.g., a single wall oven appliance or a single or double oven range appliance. Thus, the exemplary embodiment shown in FIG. 1 is not intended to limit the present subject matter in any aspect.

Upper and lower cooking chambers 112 and 114 are configured for the receipt of one or more food items to be cooked. Oven appliance 100 includes an upper door 116 and a lower door 118 rotatably attached to body 110 in order to permit selective access to upper cooking chamber 112 and lower cooking chamber 114, respectively. Handles 120 are mounted to upper and lower doors 116 and 118 to assist a user with opening and closing doors 116 and 118 in order to access cooking chambers 112 and 114. As an example, a user can pull on handle 120 mounted to upper door 116 to open or close upper door 116 and access upper cooking chamber 112. Glass window panes 122 provide for viewing the contents of upper and lower cooking chambers 112 and 114 when doors 116 and 118 are closed and also assist with insulating upper and lower cooking chambers 112 and 114.

An upper heating element (not shown) and a lower heating element (not shown) are positioned within or adjacent upper cooking chamber 112 and lower heating chamber 114 of body 110, respectively. The upper and lower heating elements are used to heat upper cooking chamber 112 and lower heating chamber 114, respectively, for both cooking and cleaning of oven appliance 100. The size and heat output of the upper and lower heating elements can be selected based on the e.g., the size of oven appliance 100. The upper and lower heating elements can include any suitable mechanism for heating oven appliance 100. For example, the upper and lower heating elements may include electric resistance heating elements, gas burners, microwave heating elements, halogen heating elements, or suitable combinations thereof.

Operation of the oven appliance 100 is regulated by a controller (not shown) that is operatively coupled to various components of oven appliance 100, including a control panel 130. Control panel 130 includes a plurality of user inputs 132 and a display 134. Control panel 130 may be in communication with the controller via one or more signal lines or shared communication busses.

Control panel 130 provides selections for user manipulation of the operation of oven appliance 100. For example, a user can actuate user inputs 132 and signal the controller. In response to user manipulation of user inputs 132, the controller operates various components of the oven appliance 100. User inputs 132 of control panel 130 can be any suitable user input. For example, user inputs 132 may include various input components, such as one or more of a variety of touch-type controls, electrical, mechanical or electro-mechanical input devices including rotary dials, push buttons, and touch pad.

Control panel 130 also provides a user with information regarding operation of oven appliance 100. For example, display 134 can present information to an appliance user. In particular, display 134 can show the current time or the operating temperature of upper and/or lower cooking chambers 112 and 114. Display 134 can be a liquid crystal display, a dot matrix display, a series of seven-segment displays, etc.

Figure 2:
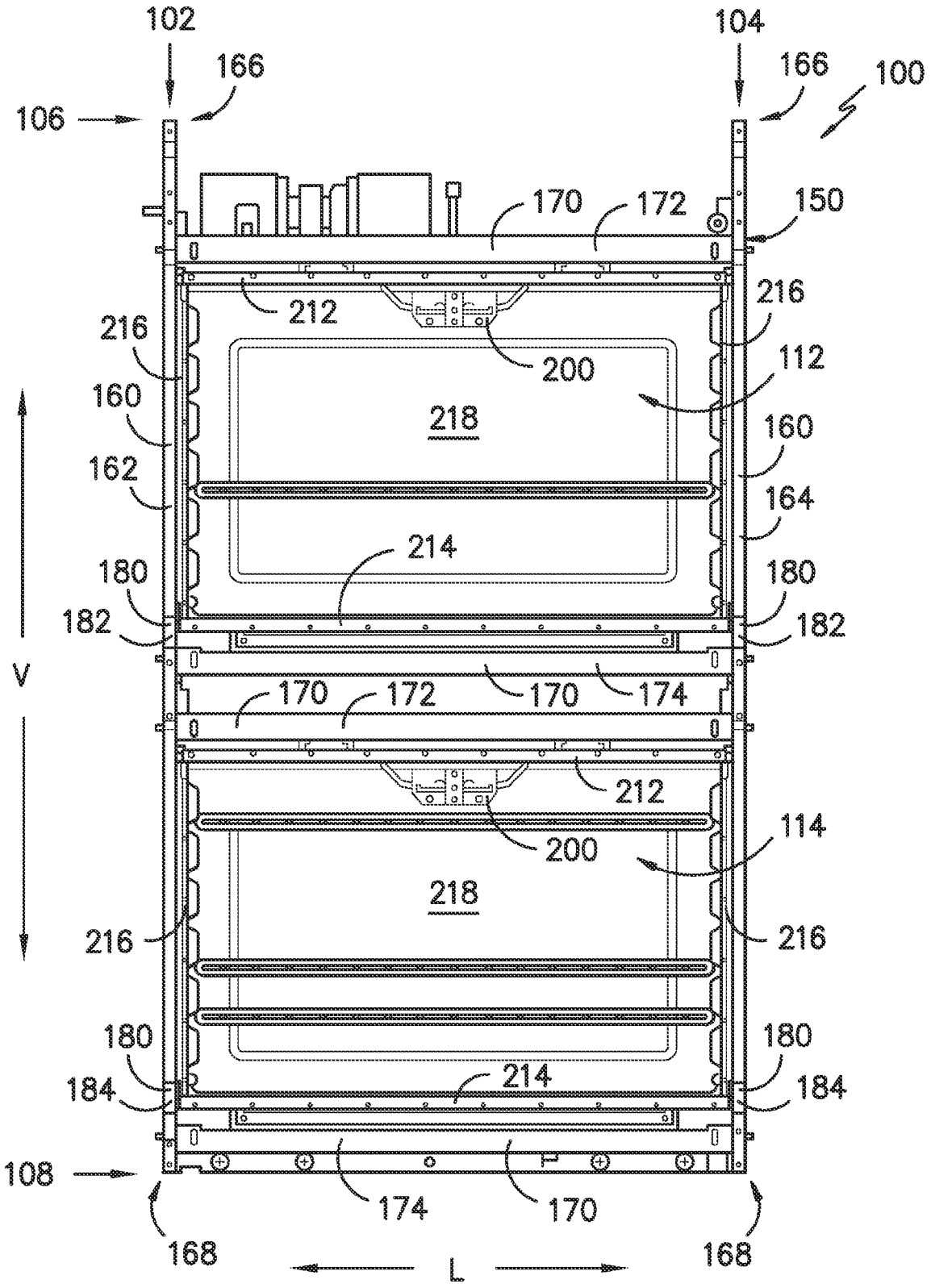
FIG. 2 provides a front, section view of the exemplary oven appliance of FIG. 1.

FIG. 2 provides a front, section view of oven appliance 100. FIG. 3 provides a side, section view of oven appliance 100 taken along the 3-3 line of FIG. 1. As may be seen in FIGS. 2 and 3, oven appliance 100, e.g., body 110, includes a frame structure 150. Various components of oven appliance 100 are mounted to frame structure 150 as discussed in greater detail below.

Figure 4:
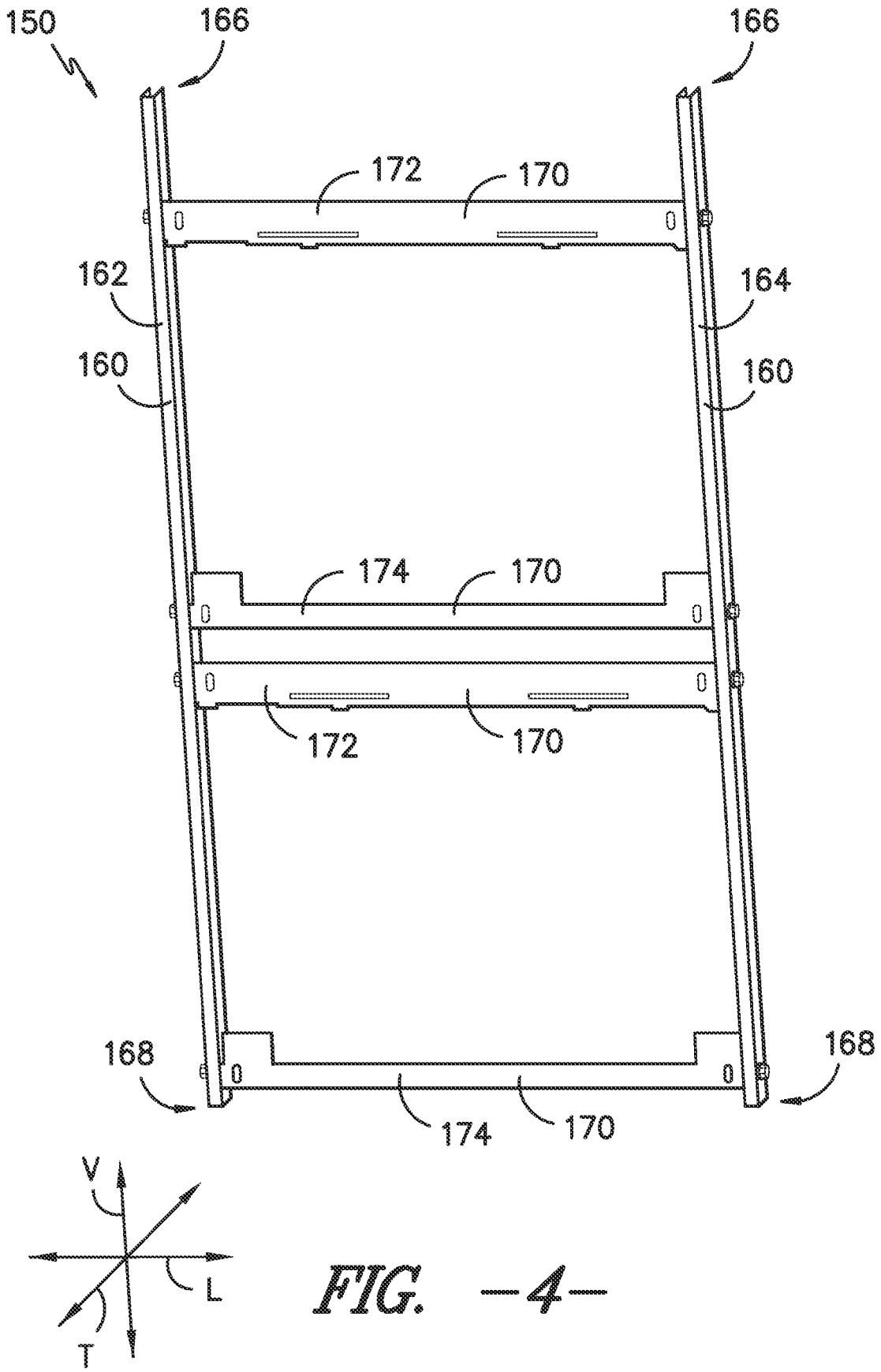
FIG. 4 provides a perspective view of a frame structure according to an exemplary embodiment of the present subject matter.
Figure 5:
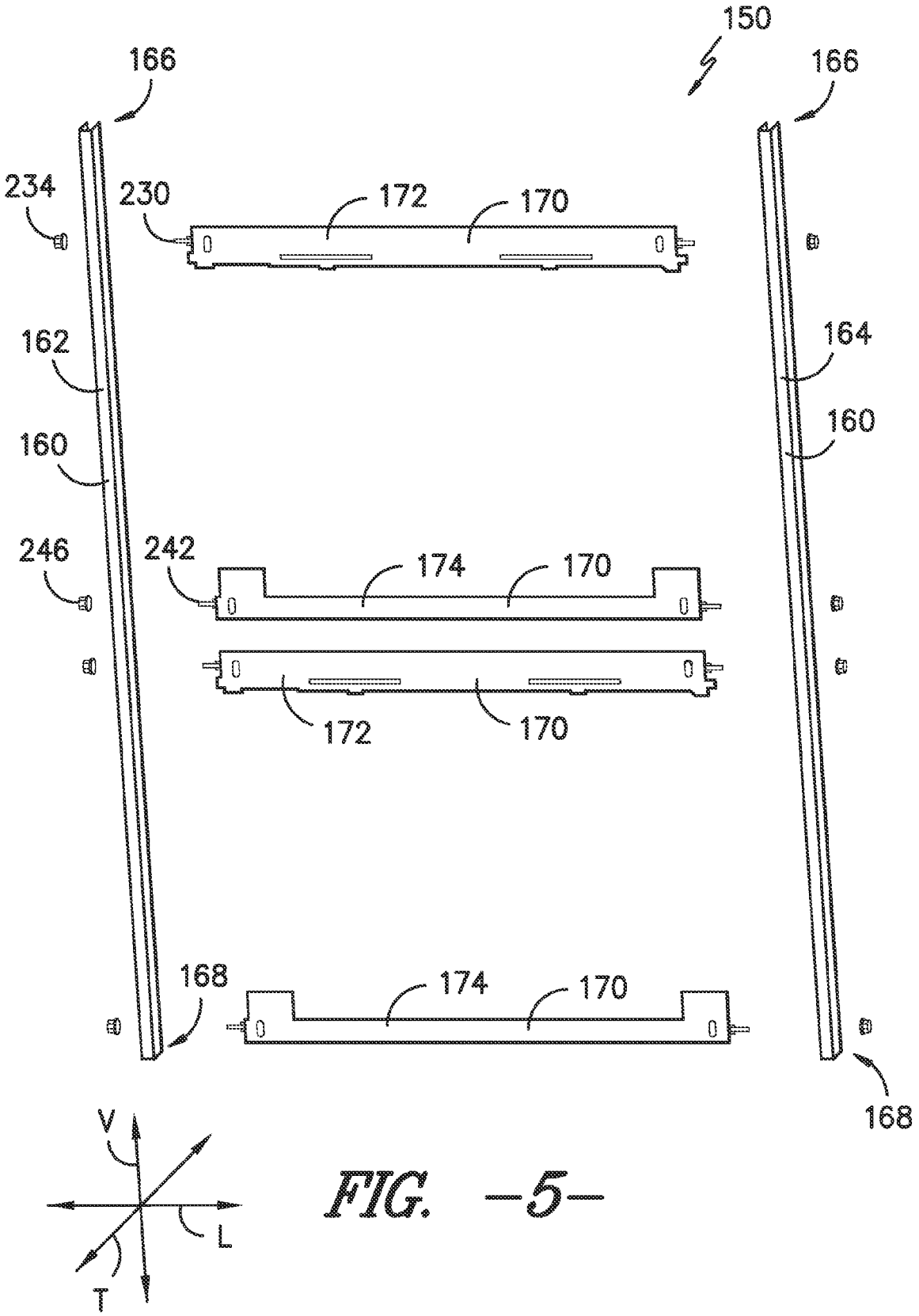
FIG. 5 provides an exploded view of the exemplary frame structure of FIG. 4.

FIG. 4 provides a perspective view of frame structure 150 of oven appliance 100. FIG. 5 provides an exploded view of frame structure 150 of oven appliance 100. It should be understood that frame structure 150 is not limited to use in oven appliance 100, and, frame structure 150 can be used in or with any other suitable appliance in alternative exemplary embodiments. For example, frame structure 150 may be configured for use in a dishwasher appliance, a trash compactor, a washing machine appliance, a dryer appliance, etc. in alternative exemplary embodiments.

As may be seen in FIGS. 4 and 5, frame structure 150 includes vertical rails 160 and lateral rails 170. Vertical rails 160 are spaced apart from each other, e.g., along the lateral direction L. Lateral rails 170 are also spaced apart from each other, e.g., along the vertical direction V. Lateral rails 170 extend between vertical rails 160 and couple vertical rails 160 to each other in order to form frame structure 150.

Vertical rails 160 include a first vertical rail 162 and a second vertical rail 164. First and second vertical rails 162 and 164 are spaced apart from each other, e.g., along the lateral direction L. Lateral rails 170 include at least one top rail 172 and at least one bottom rail 174. In the exemplary embodiment shown in FIGS. 4 and 5, lateral rails 170 include two top rails 172 and two bottom rails 174 in order to top and bottom cooking chambers 112 and 114 of oven appliance 100. It should be understood that in alternative exemplary embodiments, lateral rails 170 can include any suitable number of rails. For example, lateral rails 170 may include one, three, four, or more top rails and one, three, four, or more bottom rails in alternative exemplary embodiments.

Top and bottom rails 172 and 174 are spaced apart from each other, e.g., along the vertical direction V. In particular, each bottom rail 174 is positioned below an associated top rail 172 along the vertical direction V. Top rail 172 extends between first and second vertical rails 162 and 164 along the lateral direction L. Bottom rail 174 also extends between first and second vertical rails 162 and 164 along the lateral direction L. Thus, top and bottom rails 172 and 174 couple first and second vertical rails 162 and 164 to each other in order to form frame structure 150.

Turning back to FIGS. 2 and 3, various components of oven appliance 100 are mounted to frame structure 150 as discussed above. As may be seen in FIG. 3, upper door 116, lower door 118 and control panel 130 are mounted to frame structure 150. By mounting such components of oven appliance 100 to frame structure 150, spacing or gaps between such components can be controlled and regulated, e.g., in order to improve a cosmetic appearance of oven appliance 100, as discussed in greater detail below.

Body 110 extends between a front portion 140 and a back portion 142, e.g., along the transverse direction T. Frame structure 150 is positioned at or adjacent front portion 140 of body 110. Upper door 116, lower door 118 and control panel 130 are also positioned at or proximate front portion 140 of body 110. Thus, upper door 116, lower door 118 and control panel 130 can be visible to a user of oven appliance 100.

As may be seen in FIG. 2, each vertical rail of vertical rails 160 is positioned at or adjacent a respective one of first and second side portions 102 and 104 of body 110. In particular, first vertical rail 162 is positioned at or adjacent first side portion 102 of body 110. Second vertical rail 164 is positioned at or adjacent second side portion 104 of body 110.

Each vertical rail of vertical rails 160 also extends between a first end portion 166 and a second end portion 168. First end portion 166 of each vertical rail is spaced apart from second end portion 168 of each vertical rail, e.g., along the vertical direction V. First end portion 166 of each vertical rail is positioned at or adjacent top portion 106 of body 110. Second end portion 168 of each vertical rail is positioned at or adjacent bottom portion 108 of body 110.

Oven appliance 100 also includes pairs of hinges 180. Each hinge of hinges 180 is mounted to one of vertical rails 160. Upper and lower doors 116 and 118 are rotatably mounted to frame structure 150 with hinges 180. Hinges 180 include a first pair of hinges 182 and a second pair of hinges 184. Each hinge of first set of hinges 182 is mounted to a respective one of first and second vertical rails 162 and 164 in order to rotatably mount upper door 116 to frame structure 150. Each hinge of second set of hinges 184 is mounted to a respective one of first and second vertical rails 162 and 164 in order to rotatably mount lower door 118 to frame structure 150.

Control panel 130 is also mounted to vertical rails 160. In particular, control panel 130 includes brackets 186, e.g., positioned opposite user inputs 132 on control panel 130. Each bracket of brackets 186 is mounted to a respective one of first and second vertical rails 162 and 164 in order to mount control panel 130 to frame structure 150.

Control panel 130 is positioned above upper door 116, e.g., along the vertical direction V. Similarly, upper door 116 is positioned above lower door 118, e.g., along the vertical direction V. As may be seen in FIGS. 1 and 3, control panel 130 has a bottom edge 190 and upper door 116 has a top edge 192. Bottom edge 190 of control panel 130 and top edge 192 of upper door 116 are spaced apart from each other along the vertical direction V and define a gap $G_{top}$, e.g., along the vertical direction V, therebetween. In addition, upper door 116 has a bottom edge 194 and lower door 118 has a top edge 196. Bottom edge 194 of upper door 116 and top edge 196 of lower door 118 are spaced apart from each other along the vertical direction V and define a gap $G_{bottom}$, e.g., along the vertical direction V, therebetween.

Gaps $G_{top}$ and $G_{bottom}$ extend along the lateral direction L between about first and second side portions 102 and 104 of body 110. Mounting hinges 180 and brackets 186 of control panel 130 to vertical rails 160 can assist with sizing gaps $G_{top}$, and $G_{bottom}$ such that gaps $G_{top}$ and $G_{bottom}$ are substantially constant or uniform along the lateral direction L as shown in FIG. 1. When gaps $G_{top}$ and $G_{bottom}$ are substantially uniform or constant, a cosmetic or aesthetic appearance of oven appliance 100 can be improved relative to when gaps $G_{top}$ and $G_{bottom}$ are uneven or non-uniform.

Additional components of oven appliance 100 can also be mounted to frame structure 150 in order to assist with manufacturing oven appliance 100. In particular, oven appliance 100 includes door latches 200 for selectively securing upper and lower doors 116 and 118 in a closed position. Door latches 200 are mounted to top rails 172. By mounting door latches 200 to top rails 172, a location of door latches 200 relative to upper and lower doors 116 and 118 can be more easily determined or controlled during manufacturing of oven appliance 100.

A bottom trim 201 of oven appliance 100 is also mounted to frame structure 150 in order to assist with manufacturing oven appliance 100. Bottom trim 201 is positioned at or adjacent bottom portion 108 of body 110 and is mounted to vertical rails 160. By mounting bottom trim 201 to vertical rails 160 along with upper and lower doors 116 and 118 and control panel 130, spacing between upper and lower doors 116 and 118, control panel 130, and bottom trip 201 and a position of such components relative to each other can be precisely and/or accurately controlled.

As may be seen in FIGS. 2 and 3, oven appliance 100 also includes a set of panels 210 for defining upper and lower cooking chambers 112 and 114. Set of panels 210 includes top panels 212 and bottom panels 214. The top panel 212 and bottom panel 214 used to construct upper cooking chamber 112 are spaced apart from each other, e.g., along the vertical direction V, with such top panel 212 mounted to a respective top rail 172 and such bottom panel 214 mounted to a respective bottom rail 174. Lower cooking chamber 114 is constructed in the same or a similar manner. By mounting top and bottom panels 212 and 214 in such a manner, a location of top panels 212 relative to lower panels 214 can be more easily determined or controlled during manufacturing of oven appliance 100.

Set of panels 210 also include side panels 216 and back panels 218. The side panels 216 used to construct upper cooking chamber 112 are spaced apart from each other, e.g., along the lateral direction L. The top panel 212 and bottom panel 214 used to construct upper cooking chamber 112 extend between and connect such side panels 216 in order to form upper cooking chamber 112. Lower cooking chamber 114 is constructed in the same or a similar manner.

Figure 6:
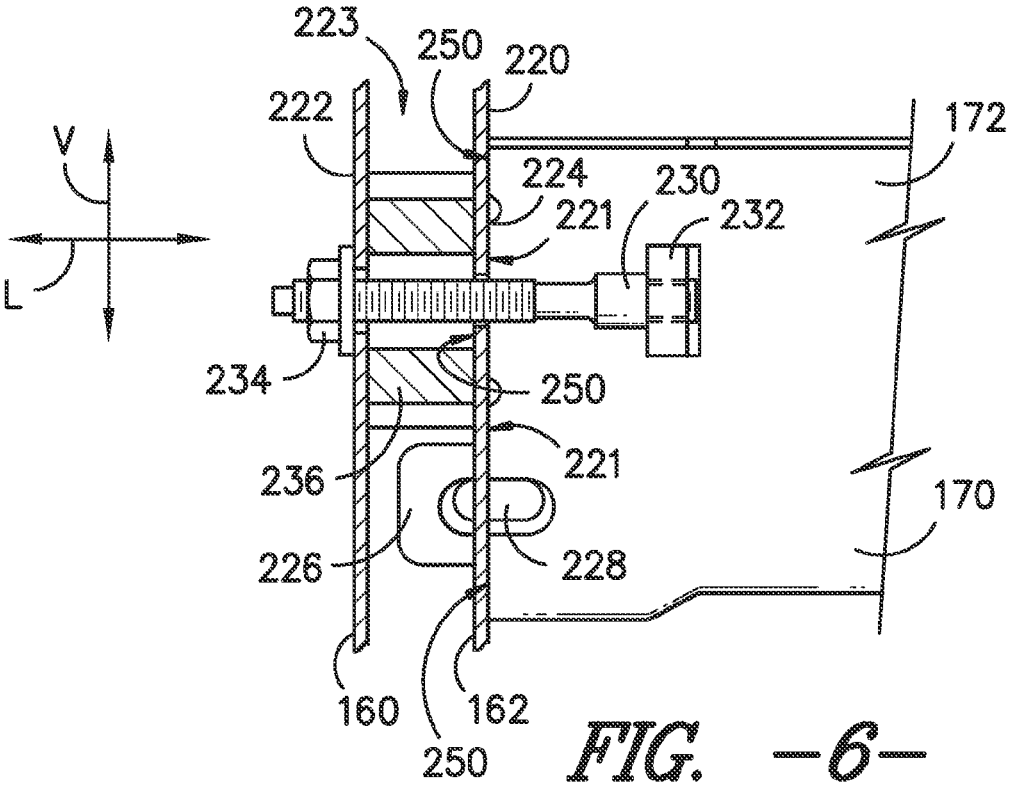
FIG. 6 provides a section view of a top rail of the exemplary frame structure of FIG. 4 mounted to a vertical rail of the exemplary frame structure of FIG. 4.

FIG. 6 provides a section view of top rail 172 of frame structure 150 mounted to first vertical rail 162 of frame structure 150. Top rail 172 of frame structure 150 may be mounted to second vertical rail 164 of frame structure 150 in the same or a similar manner. Vertical rails 160 may be constructed by bending a sheet of metal or extruding metal into a u-shape, e.g., as shown in FIG. 5. Thus, each vertical rail of vertical rails 160 may define a u-shaped profile, e.g., in a plane that is perpendicular to the vertical direction V. In certain exemplary embodiments, first vertical rail 162 includes a first plate 220 and a second plate 222 spaced apart from each other, e.g., along the lateral direction L, such that first and second plates 220 and 222 define a slot 223 therebetween as may be seen in FIG. 6.

To mount top rail 172 to first vertical rail 162, frame structure 150 includes a threaded stud 230 mounted to the top rail 172 with a t-nut 232 and also includes a lock nut 234. Threaded stud 230 extends through first vertical rail 162, e.g., both first and second plates 220 and 222 of first vertical rail 162. Lock nut 234 is threaded onto threaded stud 230, e.g., at second plate 222, in order to secure or mount top rail 172 to first vertical rail 162.

Top rail 172 also includes a top tab 224 and a bottom tab 226 that are spaced apart from each other, e.g., along the vertical direction V. First plate 220 of first vertical rail 162 defines openings 221 for receiving top and bottom tabs 224 and 226 of top rail 172. With top and bottom tabs 224 and 226 of top rail 172 positioned within openings 221, first vertical rail 162 supports top rail 172, e.g., such that movement of top rail 172 along the vertical direction V and rotation of top rail 172 is hindered or limited. Bottom tab 226 also defines an embossment 228 for limiting deflection and deformation of bottom tab 226.

Frame structure 150 also includes a compression insert 236. Compression insert 236 is received within slot 223 of first vertical rail 162. In particular, compression insert 236 extends along the lateral direction L, e.g., between first and second plates 220 and 222 of first vertical rail 162 within slot 223. Compression insert 236 is positioned proximate top rail 172, and threaded stud 230 extends through compression insert 236. Compression insert 236 can assist with hindering or limiting movement or displacement of first and second plates 220 and 222 of first vertical rail 162, e.g., when lock nut 234 is threaded onto threaded stud 230 and compressed against second plate 222.

In addition, top rail 172 includes a plurality of contact sites or points 250. In the exemplary embodiment shown in FIG. 6, top rail 172 includes three contact points 250. However, in alternative exemplary embodiments, top rail 172 can include any suitable number of contact points 250. For example, top rail 172 may include two, four, five, or more contact points 250 in alternative exemplary embodiments.

Contact points 250 of top rail 172 are, e.g., about or substantially, coplanar with one another. For example, contact points 250 of top rail 172 may be coplanar with one another in a plane that is perpendicular to the lateral direction L. Contacts points 250 of top rail 172 are positioned on or in contact with first vertical rail 162, e.g., first plate 220 of first vertical rail 162. As will be understood by those skilled in the art, rotation and other movement of top rail 172 can be hindered by having top rail 172 contact first vertical rail 162 at multiple locations, such as contact points 250 of top rail 172.

Figure 7:
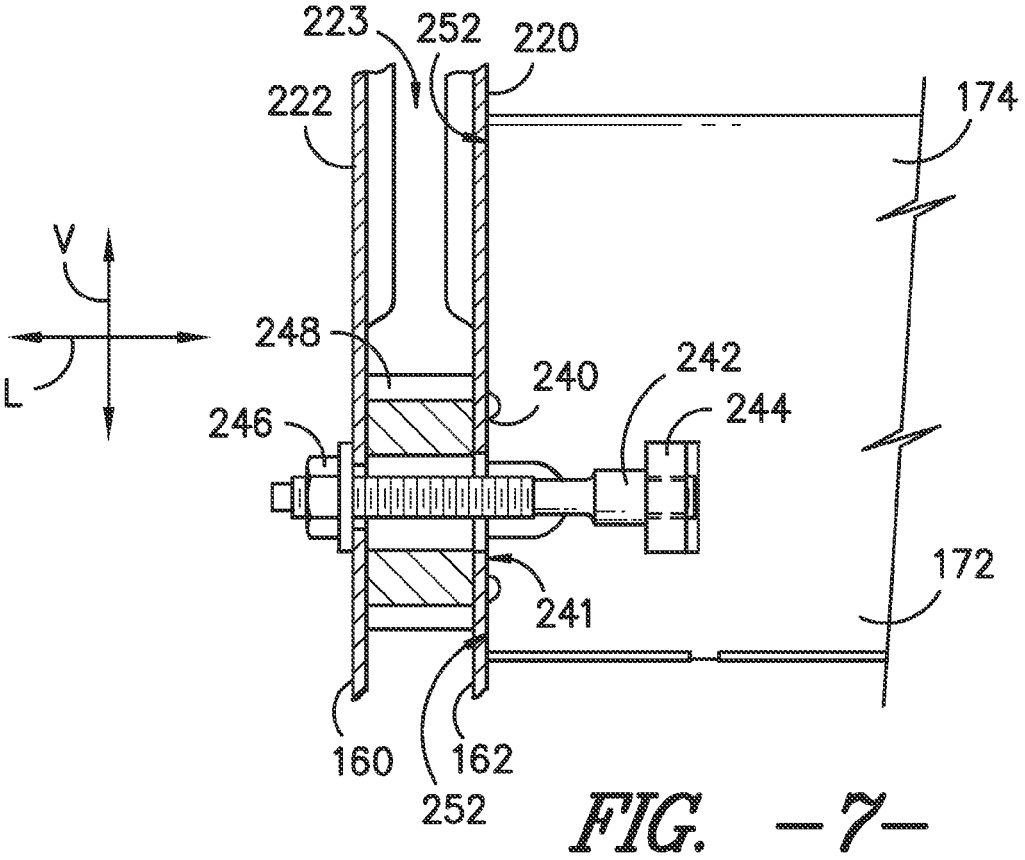
FIG. 7 provides a section view of a bottom rail of the exemplary frame structure of FIG. 4 mounted to the vertical rail of the exemplary frame structure of FIG. 4.

FIG. 7 provides a section view of bottom rail 174 of frame structure 150 mounted to first vertical rail 172 of frame structure 150. Bottom rail 174 of frame structure 150 may be mounted to second vertical rail 164 of frame structure 150 in the same or a similar manner.

As may be seen in FIG. 7, bottom rail 174 is mounted to first vertical rail 172 in a similar manner to top rail 172 shown in FIG. 6 and discussed above. In particular, frame structure 150 includes a threaded stud 242 mounted to the bottom rail 174 with a t-nut 244 and also includes a lock nut 246 in order to mount bottom rail 174 to first vertical rail 162. Threaded stud 242 extends through first vertical rail 162, e.g., both first and second plates 220 and 222 of first vertical rail 162. Lock nut 246 is threaded onto threaded stud 242, e.g., at second plate 222, in order to secure or mount bottom rail 174 to first vertical rail 162.

Bottom rail 174 also includes a tab 240. First plate 220 of first vertical rail 162 defines an opening 241 for receiving tab 240 of bottom rail 174. With tab 241 of bottom rail 174 positioned within opening 241, first vertical rail 162 supports bottom rail 174, e.g., such that movement of bottom rail 174 along the vertical direction V and rotation of bottom rail 174 is hindered or limited.

Frame structure 150 also includes an additional compression insert 248. Compression insert 248 is received within slot 223 of first vertical rail 162. In particular, compression insert 248 extends along the lateral direction L, e.g., between first and second plates 220 and 222 of first vertical rail 162 within slot 223. Compression insert 248 is positioned proximate bottom rail 174, and threaded stud 242 extends through compression insert 248. Compression insert 248 can assist with hindering or limiting movement or displacement of first and second plates 220 and 222 of first vertical rail 162, e.g., when lock nut 246 is threaded onto threaded stud 242 and compressed against second plate 222.

In addition, bottom rail 174 includes a plurality of contact sites or points 252. In the exemplary embodiment shown in FIG. 7, bottom rail 174 includes two contact points 252. However, in alternative exemplary embodiments, bottom rail 174 can include any suitable number of contact points 252. For example, bottom rail 174 may include three, four, five, or more contact points 252 in alternative exemplary embodiments.

Contact points 252 of bottom rail 174 are, e.g., about or substantially, coplanar with one another. For example, contact points 252 of bottom rail 174 may be coplanar with one another in a plane that is perpendicular to the lateral direction L. Contacts points 252 of bottom rail 174 are positioned on or in contact with first vertical rail 162, e.g., first plate 220 of first vertical rail 162. As will be understood by those skilled in the art, rotation and other movement of bottom rail 174 can be hindered by having bottom rail 174 contact first vertical rail 162 at multiple locations, such as contact points 252 of bottom rail 174.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, the oven appliance defining a vertical direction and a lateral direction, the oven appliance comprising:

an oven body having a frame structure positioned at a front portion of the body, the frame structure comprising a pair of vertical rails;

a pair of lateral rails, the lateral rails spaced apart from each other along the vertical direction, the lateral rails extending between the vertical rails along the lateral direction such that the lateral rails couple the vertical rails to each other;

a threaded stud mounted to the top rail, the threaded stud extending through the first vertical rail; and a lock nut threaded onto the threaded stud;

a door;

a pair of hinges, each hinge of the pair of hinges mounted to a respective one of the vertical rails, the door rotatably mounted to the pair of vertical rails with the pair of hinges; and a control panel mounted to the pair of vertical rails.

2. The oven appliance of claim 1, wherein the body extends between a top portion and a bottom portion along the vertical direction, each vertical rail of the air of vertical rails extending between a first end portion and a second end portion, the first end portion of each vertical rail spaced apart from the second end portion of each vertical rail along the vertical direction, the first end portion of each vertical rail positioned at the top portion of the body, the second end portion of each vertical rail positioned at the bottom portion of the body.

3. The oven appliance of claim 1, wherein the control panel is positioned above the door along the vertical direction.

4. The oven appliance of claim 3, wherein the control panel has a bottom edge and the door has a top edge, the bottom edge of the control panel and the top edge of the door defining a gap therebetween, the gap being substantially constant along the lateral direction.

5. The oven appliance of claim 1, wherein the door is a first door and the pair of hinges is a first pair of hinges, the oven appliance further comprising a second door and a second pair of hinges, each hinge of the second pair of hinges mounted to a respective one the vertical rails, the second door rotatably mounted to the body with the second pair of hinges, the second door positioned below the first door along the vertical direction.

6. The oven appliance of claim 5, wherein the first door has a bottom edge and the second door has a top edge, the bottom edge of the first door and the top edge of the second door defining a gap therebetween, the gap being substantially constant along the lateral direction.

7. The oven appliance of claim 1, wherein the body extends between a first side portion and a second side portion along the lateral direction, each vertical rail of the pair of vertical rails positioned at a respective one of the first and second side portions of the body.

8. The oven appliance of claim 1, further comprising a door latch for selectively securing the door in a closed position, the door latch mounted to a top rail of the pair of lateral rails.

9. The oven appliance of claim 1, wherein the body comprises a set of panels defining a cooking chamber for receipt of food items for cooking, the set of panels including a top panel and a bottom panel, the top panel mounted to a top rail of the pair of lateral rails, the bottom panel mounted to a bottom rail of the pair of lateral rails.

10. A frame structure for an appliance, the frame structure defining a vertical direction and a lateral direction, the frame structure comprising:

a first vertical rail;

a second vertical rail spaced apart from the first vertical rail along the lateral direction;

a top rail extending between the first and second vertical rails along the lateral direction;

a bottom rail extending between the first and second vertical rails along the lateral direction, the bottom rail positioned below the top rail along the vertical direction;

threaded stud mounted to the top rail, the threaded stud extending through the first vertical rail;

lock nut threaded Onto the threaded stud;

a compression insert, the first vertical rail defining a slot along the vertical direction such that the first vertical rail defines a u-shaped cross-section in a plane that is perpendicular to the vertical direction, the compression insert received within the slot of the first vertical rail, the compression insert positioned proximate the top rail, the threaded stud extending through the compression insert;

a door;

a pair of hinges, each hinge of the pair of hinges mounted to a respective one of the first and second vertical rails, the door rotatably mounted to first and second vertical rails with the pair of hinges; and a control panel mounted to the first and second vertical rails.

11. The frame structure of claim 10, wherein the control panel is positioned above the door along the vertical direction.

12. The frame structure of claim 11, wherein the control panel has a bottom edge and the door has a top edge, the bottom edge of the control panel and the top edge of the door defining a gap therebetween, the gap being substantially constant along the lateral direction.

13. The frame structure of claim 10, wherein the door is a first door and the pair of hinges is a first pair of hinges, the frame structure further comprising a second door and a second pair of hinges, each hinge of the second pair of hinges mounted to a respective one the first and second vertical rails, the second door rotatably mounted to the first and second vertical rails with the second pair of hinges, the second door positioned below the first door along the vertical direction.

14. The frame structure of claim 13, Wherein the first door has a bottom edge and the second door has a top edge, the bottom edge of the first door and the top edge of the second door defining a gap therebetween, the gap being substantially constant along the lateral direction.

15. The frame structure of claim 10, further comprising a door latch for selectively securing the door in a closed position, the door latch mounted to the top rail.

16. The frame structure of claim 10, further comprising a set of panels defining a chamber, the set of panels including a top panel and a bottom panel, the top panel mounted to the top rail, the bottom panel mounted to the bottom rail.

* * * * *